United States Patent [19]

Rosenthal et al.

[11] 4,283,268

[45] Aug. 11, 1981

[54] TWO-STAGE COAL LIQUEFACTION PROCESS WITH INTERSTAGE GUARD BED

[75] Inventors: Joel W. Rosenthal, El Cerrito; Christopher W. Kuehler, Larkspur, both of Calif.

[73] Assignee: Chevron Research Company, San Francisco, Calif.

[21] Appl. No.: 943,586

[22] Filed: Sep. 18, 1978

[51] Int. Cl.[3] ..... C10G 1/00; C10G 1/06; C10G 45/00; C10G 25/00

[52] U.S. Cl. ..... 208/8 LE; 208/10; 208/89; 208/91

[58] Field of Search ..... 208/8 LE, 10, 89, 91

[56] References Cited

U.S. PATENT DOCUMENTS

| | | | |
|---|---|---|---|
| 2,956,004 | 10/1960 | Conn et al. | 208/91 |
| 2,987,470 | 6/1961 | Turken | 208/91 X |
| 3,365,389 | 1/1968 | Spars et al. | 208/59 |
| 4,018,663 | 4/1977 | Karr | 208/10 |
| 4,083,769 | 4/1978 | Hildebrand et al. | 208/10 |
| 4,111,788 | 9/1978 | Chervenak et al. | 208/10 |
| 4,151,072 | 4/1979 | Nowack et al. | 208/182 |

*Primary Examiner*—Delbert E. Gantz
*Assistant Examiner*—William G. Wright
*Attorney, Agent, or Firm*—D. A. Newell; R. H. Evans; A. H. Uzzell

[57] ABSTRACT

An improved coal liquefaction process is disclosed wherein subdivided coal is substantially dissolved in a process-derived solvent in the presence of added hydrogen, thereby forming a mixture of dissolved coal, solvent and insoluble solids, and said mixture is passed through a guard bed of solid porous contact material, such as alumina, in the presence of hydrogen, to deposit titanium, iron and calcium from the mixture prior to hydrocracking.

9 Claims, 1 Drawing Figure

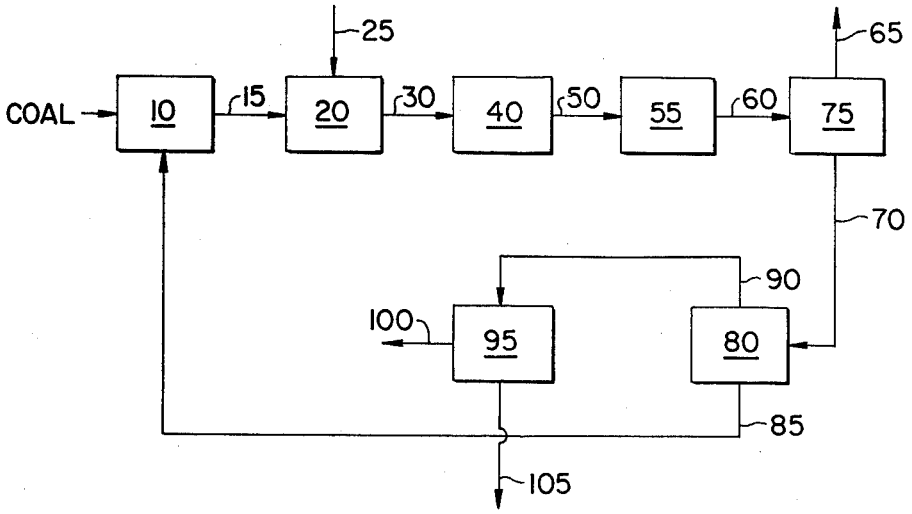
COAL
10
15
20
25
30
40
50
55
60
75
65
70
90
80
85
95
100
105

TWO-STAGE COAL LIQUEFACTION PROCESS WITH INTERSTAGE GUARD BED

BACKGROUND OF THE INVENTION

1. Field of the Invention

The present invention relates to an improved process for the liquefaction of raw subdivided coal. More particularly, the invention relates to an improved liquefaction process wherein the coal is dissolved in a hydrogen donor-type solvent, passed through a guard bed, and hydrocracked.

2. Prior Art

Coal is our most abundant indigenous fossil fuel resource, and as a result of dwindling petroleum reserves, concerted research efforts are being directed towards recovery of liquid hydrocarbons from coal on a commercial scale. A promising approach in this field relates to the direct liquefaction of coal accompanied with minimum gas production. This approach has principally evolved from the early work of F. Bergius, who discovered that transportation fuels could be produced by the high-pressure hydrogenation of a paste of coal, solvent and catalyst. Later discoveries revealed the advantageous use of specific hydrogenation solvents at lower temperatures and pressures. With these solvents, such as partially saturated polycyclic aromatics, hydrogen is transferred from the solvent to the coal molecules, thus causing depolymerization and dissolution of the coal. The resulting coal liquid, however, has a high molecular weight and a corollary high viscosity, which presents considerable obstacles in removing the fine coal residue particles remaining in the liquid, since these particles typically range in size from 1 to 25 microns in diameter. The complete nature of the coal residue, or undissolved solids, is not wholly understood; however, the residue appears to be a composite of organic and inorganic species. The residue organic matter is similar to coke, and the inorganic matter is representative of the well-known coal ash constituents. Removal of the residue from the coal liquid has been considered a critical step in the prior art in the preparation of clean fuels, particularly in those processes in which the coal liquids are subjected to catalytic upgrading, such as hydrocracking. In hydrocracking processes, the presence of the coal residue contributes to catalyst pore plugging, which results in prematurely shortened run times.

SUMMARY OF THE INVENTION

In accordance with the present invention there is provided, in a process for the liquefaction of coal wherein subdivided coal is substantially dissolved in a process-derived solvent in the presence of added hydrogen, thereby forming a mixture of solvent, dissolved coal and insoluble solids, and said mixture is then hydrocracked, the improvement comprising: passing said mixture of solvent, dissolved coal and insoluble solids through a bed of solid porous contact material in the presence of hydrogen prior to hydrocracking.

Further in accordance with the present invention, the pressure in said bed of contact material is preferably maintained in the range of 35–680 atmospheres and the temperature in said bed is preferably maintained in the range of 260° C. to 450° C. Said porous contact materials preferably comprise alumina, silica, or silica-alumina composites. Quantities of catalytic hydrogenation components, preferably less than 5% by weight of the contact material, such as cobalt or molybdenum metals or their oxides or sulfides, may also be incorporated in the contact material to facilitate hydrodemetalation and deposition of inorganic species from the mixture and thus remove downstream catalyst poisons.

The interstage guard bed may take the form of an ebullient, a fixed or a moving bed of contact particles.

BRIEF DESCRIPTION OF THE DRAWING

The drawing is a block flow diagram of suitable flow paths for use in practicing one embodiment of the present invention.

DETAILED DESCRIPTION OF THE PREFERRED EMBODIMENTS

In a preferred embodiment, comminuted coal is slurried with a hydrogen-donor solvent in a mixing zone 10 in the presence of hydrogen. The effluent slurry and hydrogen from zone 10 pass to a dissolver 20, wherein the slurry is heated to dissolve at least 50 weight percent of the coal, thereby forming a mixture of solvent, dissolved coal, and coal residue. The mixture from dissolver 20 passes through a guard chamber 40 containing a bed of porous contact material to remove metals therefrom. Effluent from the guard bed is hydrocracked in zone 55 to produce recycle solvent for the mixing zone and a relatively low-viscosity liquid product which may be readily separated from any remaining coal residue.

Referring to the drawing in detail, subdivided coal is mixed with a hydrogen-donor solvent in the presence of hydrogen in mixing zone 10. The basic feedstock of the present invention is a solid subdivided coal such as anthracite, bituminous coal, subbituminous coal, lignite, or mixtures thereof. The bituminous and subbituminous coals are particularly preferred, and it is also preferred that said coals be ground to a particle size smaller than 100 mesh, Tyler Standard Sieve Size, although larger coal sizes may be processed.

The solvent will typically comprise partially hydrogenated polycyclic aromatic hydrocarbons, generally having one or more rings at least partially saturated. Examples of such materials are tetrahydronaphthalene, dihydronaphthalene, dihydroanthracene, and similar materials. Such solvents may be obtained from numerous sources, but it is preferred to use a solvent derived from the process, and particularly a 200° C. or higher boiling fraction obtained from the hydrocracking zone effluent, as described later herein.

The subdivided coal is mixed with the solvent in a solvent-to-coal weight ratio from about 0.5:1 to 5:1, and preferably from about 1:1 to 2:1. From mixing zone 10, the slurry is fed through line 15 to a dissolving zone 20, wherein the slurry is heated to a temperature in the range of 400° C. to 480° C., preferably 425° C. to 455° C., and more preferably 440° C. to 450° C., for a length of time sufficient to substantially dissolve the coal. At least 50 weight percent, and preferably greater than 90 weight percent, of the coal, on a moisture- and ash-free basis, is dissolved in zone 20, thereby forming a mixture of solvent, dissolved coal and insoluble solids, or coal residue. It is usually necessary that the slurry be heated to at least 400° C. to obtain a 50% dissolution of the coal. Further, it is usually required that the coal slurry not be heated to temperatures above 480° C. to prevent thermal cracking, which substantially reduces the overall yield of normally liquid products.

Hydrogen is also introduced into the dissolving zone through line 25 and normally comprises fresh hydrogen and recycle gas. Other reaction conditions in the dissolving zone include a residence time of 0.01 to 3 hours, preferably 0.1 to 1 hour; a pressure in the range 35 to 680 atmospheres, preferably 100 to 340 atmospheres, and more preferably 100 to 170 atmospheres; and a hydrogen gas rate of 355 to 3550 liters per liter of slurry, and preferably 380 to 1780 liters per liter of slurry. The physical structuring of the zone is such that the slurry may flow upwardly or downwardly in said zone. Preferably the zone is sufficiently elongated to attain plug-flow conditions, which permits the process of the present invention to be practiced on a continuous basis.

The dissolving zone contains no catalyst from any external source, although the mineral matter contained in the coal may have some catalytic effect. The mixture of dissolved coal, solvent and insoluble solids from dissolver 20 passes via line 30 to a guard chamber 40, containing a bed of porous solid contact material. The bed of contact material may be physically arranged in any convenient manner, such as an ebullating bed, moving bed or fixed bed. If a fixed or moving-bed operation is selected, the bed should preferably be arranged to accommodate a vertical flow of the mixture therethrough. Hydrogen is also passed through the bed with the mixture of solvent, dissolved coal and coal residue. The hydrogen may comprise hydrogen effluent directly from the dissolving zone or said hydrogen may be supplied from a separate source. A hydrogen gas rate in the range of 355 to 3550 liters per liter of slurry should be maintained through the bed. Pressures in the range of 35 to 680 atmospheres and a flow rate of solvent and dissolved coal to contact particles in the range of 0.2 to 20 LHSV should also be maintained. A preferred contact material for use in the bed is alumina, although other materials such as silica, silica-alumina composites, spent catalyst or diatomaceous earth, may be used. The contact material is preferably macroporous, having at least 10% of the pores thereof with a diameter greater than 1000 Angstroms. Quantities of hydrogenation components, preferably less than 5% by weight of the contact material, such as cobalt or molybdenum may also be added to the contact material to enhance demetalation.

It has been discovered that when the mixture of dissolved coal, solvent and insoluble materials is passed through the bed of porous contact materials in the presence of hydrogen, metals present in the mixture will form deposits on and between the contact particles. The bulk of the deposits is comprised of titanium oxide, iron sulfide and calcium carbonate. The deposit generally appears as a porous solid crust on the exterior of the contact particle. Although titanium is the most serious deposit encountered, the metal comprises only a very minor component of the coal. For example, in a run with Illinois No. 6 coal, which contained approximately 400 parts per million by weight of titanium, approximately 25% of the total metal was retained on the contact material in the form of titanium oxide. This result is surprising in view of the fact that only 0.3% of the total iron in the coal was deposited.

The mixture of dissolved coal, solvent and insoluble solids is fed through line 50 into a reaction zone 55 containing a hydrocracking catalyst. In the hydrocracking zone, hydrogenation and cracking occur simultaneously, and the higher molecular weight compounds are converted to lower molecular weight compounds, the sulfur compounds are converted to hydrogen sulfide, the nitrogen compounds are converted to ammonia, and the oxygen compounds are converted to water. Preferably, the catalytic reaction zone is a fixed-bed type, but an ebullating or a moving bed may also be used. The mixture of gases, liquids and insoluble solids preferably passes upwardly through the catalytic reaction zone, but may also pass downwardly.

The catalysts used in the hydrocracking zone may be any of the well-known and commercially available hydrocracking catalysts. A suitable catalyst for use in the hydrocracking reaction stage comprises a hydrogenation component and a cracking component. Preferably, the hydrogenation component is supported on a refractory cracking base. Suitable bases include, for example, silica, alumina, or composites of two or more refractory oxides such as silica-alumina, silica-magnesia, silica-zirconia, alumina-boria, silica-titania, silica-zirconia-titania, acid-treated clays and the like. Acidic metal phosphates such as alumina phosphate may also be used. Preferred cracking bases comprise alumina and composites of silica and alumina. Suitable hydrogenation components are selected from Group VI-B metals, Group VIII metals, and their oxides or mixtures thereof. Particularly useful are cobalt-molybdenum, nickel-molybdenum, or nickel-tungsten on silica-alumina supports.

It is preferred to maintain the temperature in the hydrocracking zone below 425° C., preferably in the range 340° C. to 425° C., and more preferably 340° C. to 400° C., to prevent fouling. The temperature in the hydrocracking zone should preferably be maintained below the temperature in the dissolving zone by 55° C. to 85° C. and may be accomplished by cooling the dissolver effluent, either before or after passing same through the guard bed. Other hydrocracking conditions include a pressure from 35 atmospheres to 680 atmospheres, preferably 70 atmospheres to 205 atmospheres, and more preferably 100 to 170 atmospheres; a hydrogen rate of 355 to 3550 liters per liter of slurry, preferably 380 to 1780 liters of hydrogen per liter of slurry; and a slurry-liquid hourly space velocity in the range 0.1 to 2, preferably 0.2 to 0.5.

Preferably, the pressure in the noncatalytic dissolving stage, the guard bed and the catalytic hydrocracking stage are substantially the same.

Preferably the entire effluent from the guard bed is passed to the hydrocracking zone. However, since small quantities of water and light gases ($C_{1-C4}$) are produced in the first stage, the catalyst in the second stage is subjected to a lower hydrogen partial pressure than if these materials were absent. Since higher hydrogen partial pressures tend to increase catalyst life, it may be preferable in a commercial operation to remove a portion of the water and light gases before the stream enters the hydrocracking stage. Furthermore, interstage removal of the carbon monoxide and other oxygen-containing gases may reduce hydrogen consumption in the hydrocracking stage due to reduction of the carbon oxides.

The product effluent 60 from reaction zone 55 is separated into a gaseous fraction 65 and a solids-liquid fraction 70 in zone 75. The gaseous fraction comprises light oils boiling below about 150° C. to 260° C. and normally gaseous components such as $H_2$, CO, $CO_2$, $H_2O$ and the $C_1$ to $C_4$ hydrocarbons. Preferably the $H_2$ is separated from the other gaseous components and recycled to the hydrocracking or dissolving stages. The liquids-solid fraction 70 is fed to solids separation zone 80 wherein the stream is separated into a solids-lean stream 85 and solids-rich stream 90. The insoluble solids are separated by conventional means, for example, hydroclones, filtration, centrifugal separators and gravity settlers or any combination of said means in zone 80. Preferably, the insoluble solids are separated by gravity settling, which is a particularly added advantage of the present invention since the effluent from the hydrocracking reaction zone has a particularly low viscosity and a relatively low specific gravity of less than 1. The low gravity of the effluent allows rapid separation of the solids by gravity settling such that generally, 90 weight percent of the solids can be rapidly separated. Preferably, the insoluble solids are removed by gravity settling at an elevated temperature in the range 90° C. to 425° C., preferably 150° C. to 205° C., and at a pressure in the range 1 atmosphere to 340 atmospheres, preferably 1 atmosphere to 70 atmospheres. Separation of the solids at an elevated temperature and pressure is particularly desirable to minimize the viscosity and to prevent bubbling of the liquid. The solids-lean product stream is removed via line 85 and recycled to the mixing zone, and the solids-rich stream is passed to secondary solids separation zone 95 via line 90. Zone 95 may include distillation, fluid coking, delayed coking, centrifugation, hydrocloning, filtration, settling, or any combination of the above. The separated solids are removed from zone 95 via line 100 for disposal and the product liquid is removed via line 105. The liquid product is essentially solids-free and contains less than 1.0 weight percent solids.

The process of the present invention produces extremely clean normally liquid products. The normally liquid products, that is, all of the product fractions boiling above $C_4$, have an unusually low specific gravity; a low sulfur content of less than 0.1 weight percent, generally less than 0.02; and a low nitrogen content less than 0.5 weight percent, generally less than 0.2 weight percent.

The addition of the interstage guard bed results in significantly improving the over-all process stability and in substantially increasing the hydrocracking catalyst run life. Although the exact causal relationship has not been fully established, the results indicate that removal of the iron, calcium, and titanium components is crucial in avoiding crust-like deposits on the hydrocracking catalyst, thereby resulting in greater process stability.

As is readily apparent from the drawing, the process of the present invention is simple and produces clean, normally liquid products from coal which are useful for many purposes. The broad-range product is particularly useful as a turbine fuel, while particular fractions are useful for gasoline, diesel, jet, and other fuels.

What is claimed is:

1. A process for the liquefaction of coal comprising the steps of (a) substantially dissolving subdivided coal in a dissolving stage with a solvent in the presence of hydrogen at a temperature in the range of about 400° C. to 480° C. and a pressure of about 35 to 680 atmospheres to form a first effluent mixture containing solvent, dissolved coal, and insoluble solids;

(b) passing solvent, dissolved coal and the insoluble solids from said first effluent mixture with hydrogen through a guard bed of solid porous contact material to substantially reduce the metals content of said first effluent by hydrogenation, to provide a second effluent containing solvent, dissolved coal, and insoluble solids;

(c) passing a slurry containing solvent, dissolved coal and the insoluble solids from said second effluent to a hydrocracking stage containing hydrocracking catalyst and operating under hydrocracking conditions, including a temperature in the range of about 340° to 425° C.; a pressure in the range of about 35 to 680 atmospheres and a hydrogen rate of 355 to 3550 liters per liter of slurry.

2. A process as recited in claim 1 wherein said porous contact material contains a hydrogenation component in an amount less than 5 percent by weight.

3. A process as recited in claim 2 wherein said hydrogenation component is selected from the group of cobalt and molybdenum present as metals, oxides, or sulfides.

4. A process as recited in claim 1 wherein the presence of said guard bed increases the run life of said hydrocracking catalyst.

5. A process as recited in claim 2 or 3 wherein said first effluent is passed through said guard bed of contact material under hydrodemetalation conditions including a pressure in the range of about 35 to 680 atmospheres and a temperature in the range of 260° to 450 °C.

6. A process as recited in claim 1 wherein said contact material is a material selected from the group of materials consisting of alumina, silica and silica-alumina composites.

7. A process as recited in claim 1 wherein said contact material is macroporous.

8. A process as recited in claim 1 wherein said contact material comprises at least one catalytic hydrogenation component.

9. A process as recited in claim 1 wherein said metals include titanium, iron and calcium.

* * * * *